US005193901A

United States Patent [19]

Stone

[11] Patent Number: 5,193,901

[45] Date of Patent: Mar. 16, 1993

[54] VENDING MACHINE BACK LIGHT ASSEMBLY AND METHOD

[75] Inventor: David H. Stone, Delavan, Wis.

[73] Assignee: Glo-Max Fiber Optics Systems, Inc., Walworth, Wis.

[21] Appl. No.: 771,258

[22] Filed: Oct. 4, 1991

[51] Int. Cl.[5] ..... G09F 13/04

[52] U.S. Cl. ..... 362/32; 362/30; 362/260; 362/812; 221/155; 40/547

[58] Field of Search ..... 362/27, 29, 30, 32, 362/125, 260, 806, 812; 312/223; 40/547, 545, 581, 444; 221/155

[56] References Cited

U.S. PATENT DOCUMENTS

| | | | |
|---|---|---|---|
| 1,982,236 | 11/1934 | Simpkins | 221/155 |
| 3,184,872 | 5/1965 | Way | 40/547 |
| 3,381,121 | 4/1968 | McDonald | 362/812 |
| 3,831,302 | 8/1974 | Gentilini | 362/812 |
| 4,280,122 | 7/1981 | McKinley et al. | 362/32 |
| 4,738,510 | 4/1988 | Sansom | 40/547 |
| 4,860,475 | 8/1989 | Levy et al. | 40/547 |

FOREIGN PATENT DOCUMENTS

| | | | |
|---|---|---|---|
| 3404330 | 8/1985 | Fed. Rep. of Germany | 40/442 |
| 253084 | 10/1989 | Japan | 221/155 |
| 0037490 | 2/1990 | Japan | 40/545 |
| 040788 | 2/1990 | Japan | 221/155 |
| 8500958 | 11/1986 | Netherlands | 40/545 |
| 1499121 | 1/1978 | United Kingdom | 40/547 |

*Primary Examiner*—Ira S. Lazarus
*Assistant Examiner*—Y. Quach
*Attorney, Agent, or Firm*—Potthast & Ring

[57] ABSTRACT

A vending machine (10) with a first translucent panel (18A) primarily back lit by a first back light subassembly (32) and a second translucent sign panel (18B) primarily back lit by a second back light subassembly (36) having a transformer (34), halogen housing lamp socket (54) with a halogen lamp (38) spaced above a rotatable color wheel (44) driven by a motor (46) and causing the receiving end of a fiber optic cable (40) to convey light to selected locations on the second translucent sign panel (18B) all of which are held together in proper position and mounted together by means of a single elongate frame (62) with transverse arm (62A, 62B and 62C) and preconnected with the same source of power (50) as is connected to the first panel (18A).

29 Claims, 2 Drawing Sheets

VENDING MACHINE BACK LIGHT ASSEMBLY AND METHOD

BACKGROUND OF THE INVENTION

1. Field of the Invention

This invention relates to a back light assembly for the translucent display panel of a vending machine and method and, more particularly, to such a back light assembly in which both space transmission and fiber optic transmission of light to the translucent panel is employed.

2. Description of the Related Art Including Information Disclosed Under 37 CFR 1.97–1.99

Vending machines of the type having a mechanism for dispensing a food item, such as a container of cola or other flavored soft drink, and a controller responsive to receipt of payment for actuating the dispensing means are well known. The food items, dispensing means and controller and a back light assembly are all contained within a common housing defined in part by a translucent sign panel forming all or part of the front wall of the vending machine.

A difficulty with such vending machines is that often the internal workings of the vending machines, such as the controller, can interfere with the passage of light from the back light assembly to parts of the front wall. Consequently, this factor disadvantageously results in uneven lighting of the translucent sign panel which renders all or part of the sign panel unsightly and ineffective.

While it is known to use fiber optic cables to provide back lighting for signage, generally such signage arrangements utilize only a single light source having its own separate power supply. However, such fiber optic signage arrangements employ only a single light source conducted through the fiber optic cable such that if the one light source lost, all back lighting of the signage is lost. Likewise, in nonfiber optic lighting systems, such as a fluorescent lighting system, should the fluorescent light misfunction, then the back light of the entire sign is lost.

There are many vending machines which have only fluorescent back light translucent sign panels which could benefit from additional translucent sign panel area, improved luminance or reliability, but there are no known vending machines which have overcome these signage problems.

SUMMARY OF THE INVENTION

It is therefore the principal object of the present invention to provide a vending machine with a back light assembly and a method of highlighting a selected portion of a vending machine translucent sign panel which overcome the aforementioned problems of known back lit vending machines.

This objective is achieved in part through provision of an electrical back light assembly for a vending machine having a mechanism for dispensing a food item and a controller responsive to receipt of payment for actuating the dispenser, all contained within a common housing defined in part by a translucent sign panel, the improvement being an electrical back light assembly, comprising a source of electrical power, a first back light subassembly including a first back light source connected with the source of electrical power to primarily light a first portion and to secondary light second portion of the translucent sign panel, a second back light subassembly including a second light source connected with said source of electrical power and including a fiber optic cable for conducting light from the first light source to primarily illuminate only the second portion of the panel.

The object of the invention is also achieved by providing a vending machine in which said fiber optic cable conducts part of the light from the first light source to the second portion of the panel.

The object of the invention is also achieved by provision of an electrical back light assembly in which said fiber optic cable has a receiving end open for receipt of light from both the first light source and the second light source.

The object of the invention is also obtained by providing a vending machine in which the fiber optic cable has a receiving end facing in an upward direction and the first light source has at least a portion thereof located above the receiving end to transmit light directly to the open end.

The objective is also acquired by provision of an electrical back light assembly for a vending machine with an electrical back light system having a first back light subassembly including a source of light directed through open space toward both the first and second portions of the translucent panel and a second back light subassembly including a fiber optic cable for directing light to the second portion of the translucent sign panel at least partially obscured from the light of the first back light subassembly.

In a preferred embodiment of the vending machine, preferably a dispenser is interposed between the first back light subassembly and said second portion of the translucent sign panel and a fiber optic cable directs light around the dispenser to impinge on said second portion of the translucent sign panel.

The object of the invention is achieved by providing a vending machine in which the electrical back light assembly has a common power supply and both said first back light subassembly and said second back light subassembly include means connected with said common power supply for deriving power.

The object of the invention is additionally achieved by provision of a vending machine in which the second back light assembly includes a relatively intensive light source of an intensity greater, than the light source of the first back light subassembly and a color wheel interposed between the relative intensive light source and the fiber optic cable.

The invention also contemplates a method of highlighting a selected portion of a translucent sign panel defining at least part of the front of a housing of a vending machine, comprising the steps of:

(a) obscuring the selected portion with an obstruction contained within the housing from a general back light source within the housing;

(b) generating a light from a second light source of intensity relatively greater than light from the general back light source; and (c) conveying the light from the second relatively more intensive light source around the obstruction to impinge upon the selected portion of the translucent sign panel.

The invention also advantageously overcomes the problems of early retrofitting an existing vending machine with the benefits of the invention by provision of a back light assembly for a vending machine having a mechanism for dispensing a food item, a controller responsive to receipt of payment for actuating the dispenser and a general back light assembly all contained within a common housing defined in part by a translucent panel including a first and second subpanel with an elongate frame with means for mounting the frame to a wall of the housing spaced from the translucent panel, a lamp socket mounted to the elongate frame and having means for releasable connection with an electrical lamp and means for releasable connection with the power supply to obtain electrical power therefrom to light the lamp, a color wheel mounted to the frame at a location relative to the lamp socket to receive light from an electrical lamp releasably connected therewith, a fan mounted to the frame for cooling the environment adjacent the lamp socket, means for releasably mounting the second translucent subpanel into generally flush engagement with the first subpanel, an elongate bundle of fiber optic cables having one end mounted to the frame for receipt of light through the color wheel from the electrical lamp and means for mounting the distal end of the bundle of fiber optic cables relative to the second translucent subpanel to convey light received at the one end to selected locations on the second subpanel.

In the preferred embodiment, the vending machine of the present invention includes means for mounting color wheel for rotation and an electrical motor mounted to the frame to rotatably drive the color wheel. Also, the color wheel is preferably located intermediate the lamp socket and the electrical motor, and the back light assembly includes means for mounting the one end of the bundle of fiber optic cables and means for mounting the one end to the electrical motor. The mounting means mounts the fan to the frame intermediate the lamp socket and the color wheel.

The object of the invention is also partly obtained by providing the aforementioned vending machine with a back light assembly having a frame with an elongate member for connection along a side wall of the housing and transverse arms mounted and extending from one side of along the length of the elongate member for attaching the lamp socket, color wheel and the one end of the fiber optic cable in preselected spatial relationship.

BRIEF DESCRIPTION OF DRAWING

The foregoing objects and advantageous features of the invention will be explained in greater detail and others will be made apparent from the detailed description of the preferred embodiment of the present invention which is given with reference to the several figures of the drawing, in which.

DESCRIPTION OF THE PREFERRED EMBODIMENT

Figure 1:
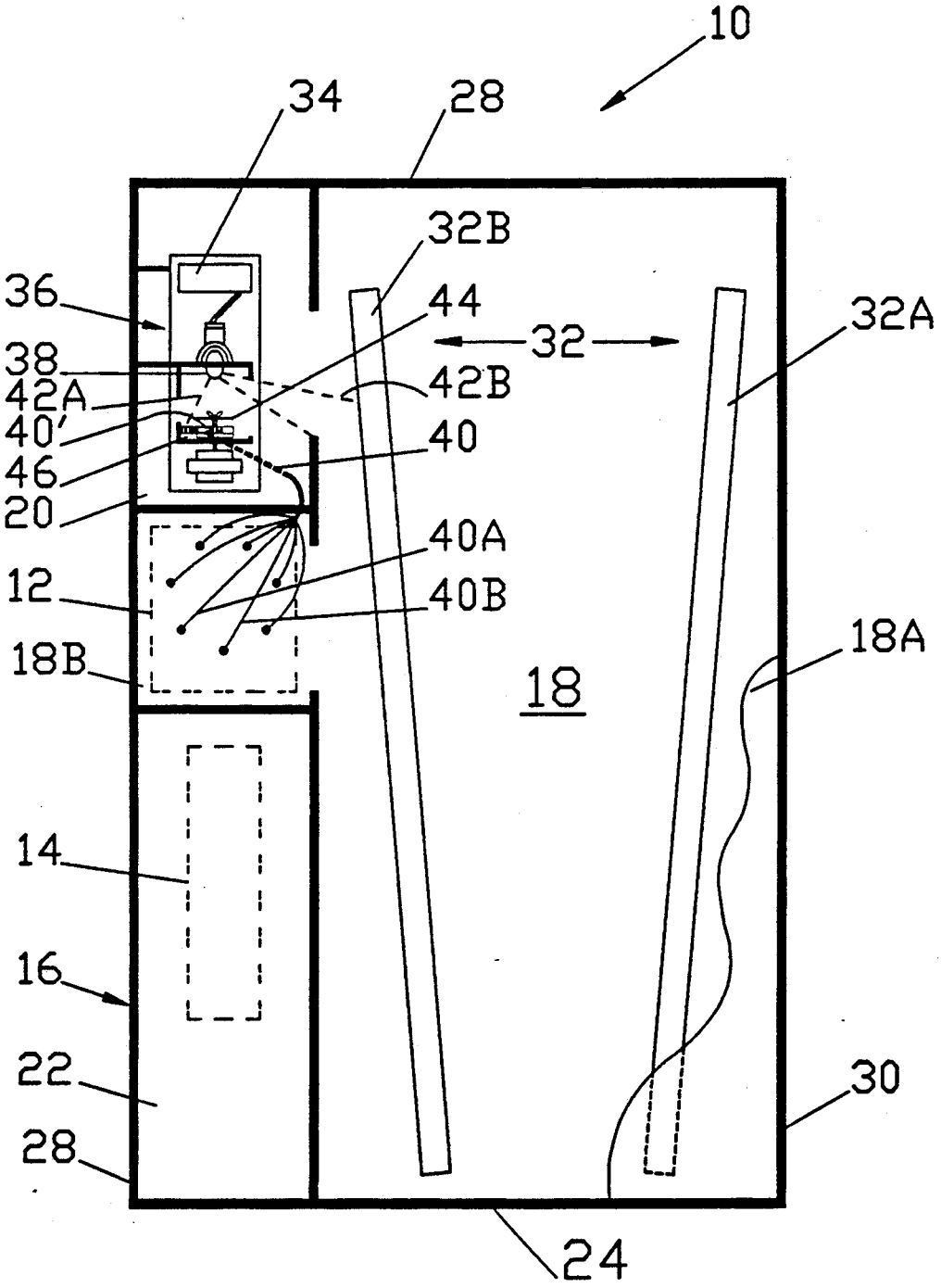
FIG. 1 is a partially schematic front view of the preferred embodiment of the vending machine with the back light assembly of the present invention.

Referring now to FIG. 1, the preferred embodiment of the vending machine 10 of the present invention is seen to include a mechanism for dispensing a food item, or dispenser, 12 and a controller 14 responsive to receipt of payment for actuating the dispenser 12. Both the dispenser 12 and the controller 14 are mounted within a rectangular housing 16 which is defined in part by a translucent panel sign assembly,, 18 that bears a sign and logo (not shown). Translucent panel sign assembly 18 includes a relatively large first rectangular translucent panel 18A and a relatively small, second translucent panel 18B. The first rectangular and second translucent panels 18A and 18B are secured together with each other and with two other panels 20 and 22 to form a rectangular front of the rectangular housing 16. The rectangular housing 16 also has a bottom 24, top 26 and opposite sides 28 and 30.

In keeping the objective of the invention, the rectangular housing 16 also protectively contains a first back light subassembly 32 which includes fluorescent lamps 32A and 32B. The fluorescent lamps 32A and 32B extend substantially the entire height of the rectangular housing 16 between bottom 24 and top 26 and function as the primary, light source for back lighting of the first rectangular translucent panel 18A. In addition, both fluorescent lamps 32A and 32B receive electrical power from a power source also connected with the input of an electrical transformer 34 through suitable electrical connection (not shown).

The second translucent panel 18B is advantageously provided in a location relative to the fluorescent lamps 32A and 32B of the first back light subassembly to allow light tracking therefrom to impinge upon and thus back light the second translucent panel. However, as will be explained, while it is desirable to have some of the light from fluorescent lamp 32A and fluorescent lamp 32B to strike the second translucent panel 18B, an obstruction in the preferred form of the dispenser 12 is located intermediate the second translucent panel 18B and the lamps 32A and 32B to partially occlude the light. However, the dispenser 12 is located approximately one fourth inch away from the back of the second translucent panel 18B. In this way, the light is partly occluded to ensure that the primary back light for the second translucent sign panel 18B comes from a second back light subassembly 36, described in detail below. Thus, should the second back light subassembly 36 fail to operate, some back light will still be available to at least partially back light the second translucent panel 18B. The second back light subassembly 36 is located above the dispenser and aligned with, rather than opposite of, the back of panel 18B.

Instead of relying upon the transmission of light through space as with the first back light subassembly 32, in keeping with the present invention, the light from an incandescent light source such as halogen lamp 38 is conveyed via a bundle of fiber optic cable 40 made of a plurality of fiber optic filaments, such as filaments 40A, 40B, etc. Advantageously, light from halogen lamp 38 is conveyed through air via path 42A to a receiving end 40, of the fiber optic cable 40 and thus is also freely conveyed through air via a light transmission path 42B to secondarily impinge upon the first rectangular translucent panel 18A, if needed.

As will be explained in greater detail with reference to FIG. 2, the second back light subassembly also includes a rotatably mounted color wheel 44 comprised of a plurality of different color filters on a disc through which light from halogen light 38 passes before striking the receiving end of 40' of the fiber optic cable 40. An electric motor 46 functions to drive the color wheel 44 to rotate and thereby partially change the spectrum of the light conveyed to the second translucent panel 18B.

Figure 2:
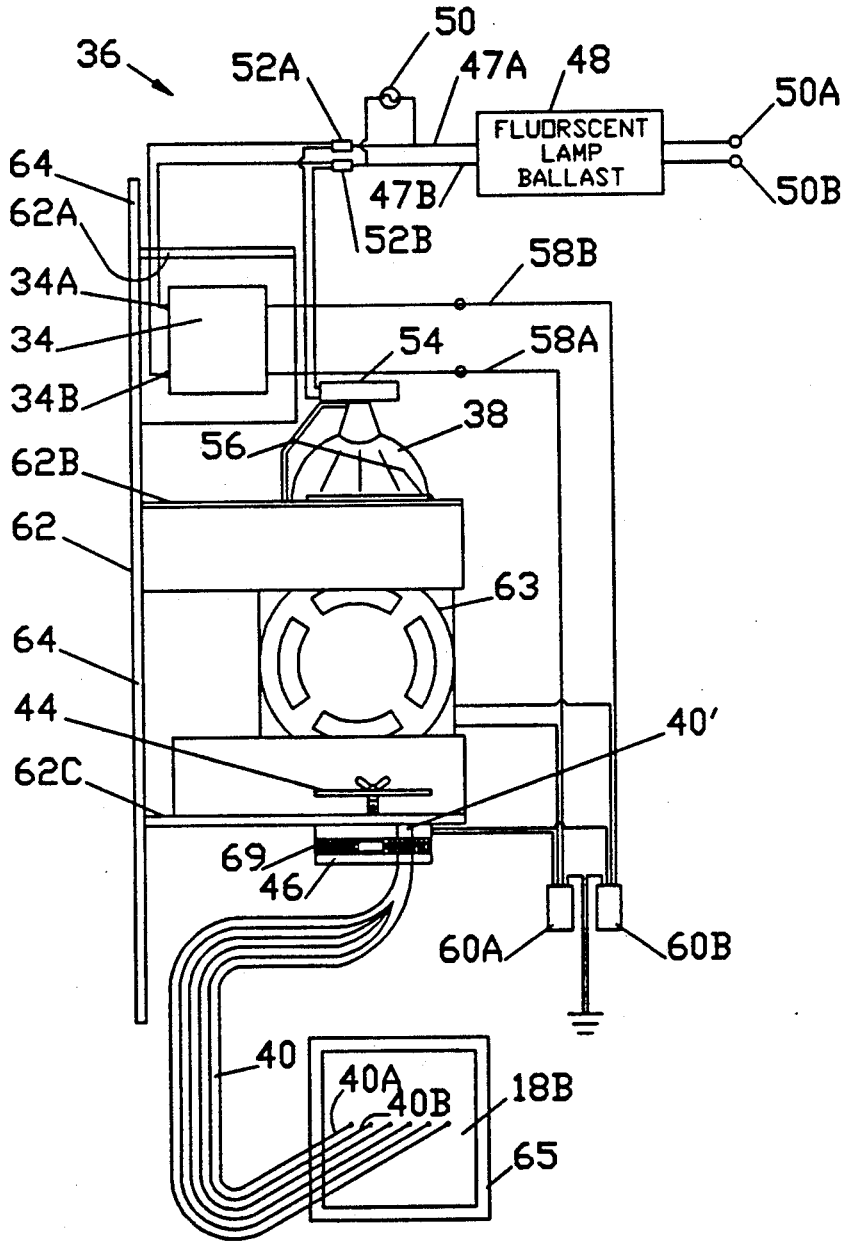
FIG. 2 is a partially schematic detailed front view of the preferred embodiment of the fiber optic back light subassembly shown generally in FIG. 1.

Turning now to FIG. 2, the second back light subassembly 36 is seen in greater detail to include suitable connectors for making electrical connection of the input 34A and 34B of transformer 34 with inputs of 47A and 47B of fluorescent lamp ballast 48 to derive power therefrom via a conventional source of AC power. The fluorescent lamp ballast has outputs 50A and 50B which are connected to power fluorescent lamps 32A and 32B. The inputs of transformer 34A and 34B in addition to being connected to inputs 47A and 47B of the fluorescent lamp ballast 48, are also connected via suitable connectors 52A and 52B to a lamp socket 54 releasably connected to apply power to halogen lamp 38. The halogen lamp 38, preferably not more than seventy-five watts, is supported in engagement with the lamp socket 54 via a lamp support clip 56. In addition, the transformer 34 has a pair of outputs 58A and 58B connected via connectors 60A and 60B to power both the electrical motor 46 but also an electrical fan 63. The fan 63 is interposed between the lamp 38 and the color wheel 44 to control the housing temperature and prevent excess heat accumulation adjacent the halogen lamp 38 for enhanced useful life.

The receiving end 40' of the fiber optic cable 40 is held in place beneath one side of the color wheel 44 by means of a releasable strap 69. The fiber optic cable 40 is then flexibly routed downwardly from the receiving end 40' to the second translucent panel 18B. The ends of the filaments 40A, 40B, etc. are inserted into mating holes in the back side of the second translucent panel 18B and held there by a suitable adhesive.

The objective of the invention is achieved in part by mounting all of the components of the second back light subassembly to a single elongate frame 62 having predrilled holes 64 for mounting the frame to wall 28 of the housing 18 at a location spaced upwardly from the translucent panel 18B. All of the lamp socket 54, color wheel 44 and the end of the fiber optic cable 40' and the motor 46 and fan 63 are mounted to the same frame 62 by means of one or more transverse arms 62A, 62B and 62C in a preselected spatial relationship, as shown. In addition, since the elements of the second light subassembly are secured together by means of frame 62, all internal wiring between the transformer 34 and the frame 62 and motor 46 are advantageously preconnected. The translucent panel 18B is connected at the end of the filament 40A, 40B, etc., while the panel 18B has means carried by a frame 65 to releasably mount it in generally flush engagement with the sign subpanel 18A.

While a detailed description of the preferred embodiment of the invention has been given, it should be appreciated that many variations can be made thereto without departing from the scope of the invention a set forth in the appended claims.

I claim:

1. In a vending machine having a mechanism for dispensing a food item and a controller responsive to receipt of payment for actuating the dispensing mechanism, all contained within a common housing defined in part by a translucent sign panel, the improvement being an electrical back light assembly, comprising:

a source of electrical power;

a first back light subassembly including a first back light source connected with the ,source of electrical power to primarily light a first portion and to secondarily light a second portion of the translucent sign panel;

a second back light subassembly including a second back light source connected with said source of electrical power and including a fiber optic cable for conducting light from the second light source to primarily illuminate the second portion of the panel.

2. The vending machine of claim 1 in which said fiber optic cable conducts part of the light from the first back light source to the second portion of the translucent sign panel.

3. The vending machine of claim 1 in which said fiber optic cable has a receiving end open for receipt of light from both the first back light source and the second light source.

4. The vending machine of claim 1 in which said fiber optic cable has a receiving end facing in an upward direction, and said back first light source has at least a portion thereof located above the receiving end to transmit light directly to the receiving end.

5. The vending machine of claim 1 in which said first back light source is a fluorescent lamp, and said second back light source is an incandescent lamp.

6. The vending machine of claim 5 in which the second back source is a halogen lamp.

7. The vending machine of claim 1 including a color wheel subassembly having a transparent color wheel, and means for mounting the translucent color wheel intermediate the second back light source and the fiber optic cable to vary the color of the light impinging on the second portion of the translucent sign panel.

8. The vending machine of claim 7 in which said color wheel subassembly includes an electrical motor for rotating the translucent color wheel, and means for connecting the electrical motor to said source of electrical power.

9. The vending machine of claim 1 including means for partly back lighting the second portion of the translucent sign panel with light from the first back light subassembly.

10. In a vending machine having a mechanism for dispensing food items and a controller responsive to the receipt of payment for actuating the dispensing mechanism, all contained within a housing defined in part by a translucent sign panel having first and second portions, the improvement being an electrical back light system, comprising:

a first back light subassembly including a source of light directed through open space toward both the first and second portions of the translucent sign panel; and a second back light subassembly including a fiber optic cable for directing light to the second portion of the translucent sign panel at least partially obscured from the light of the first back light assembly.

11. The vending machine of claim 10 in which said dispensing mechanism is interposed between both the first and second back light subassemblies and said second portion of the translucent panel, and said fiber optic cable directs light around the dispensing mechanism to impinge on said second portion of the translucent panel.

12. The vending machine of claim 11 in which said fiber optic cable has a receiving end open to space within the housing, and said second back light subassembly has a second source of light directed toward the open receiving end.

13. The vending machine of claim 12 including a color wheel interposed between the second source of light and the receiving end of the fiber optic cable.

14. The vending machine of claim 10 in which said electrical back light system has a common power supply, and both said first back light subassembly and said second back light subassembly include means connected with said common power supply for deriving power.

15. The vending machine of claim 10 in which said second back light subassembly includes a relatively intensive light source of an intensity greater than the light source of the first back light subassembly, and a color wheel interposed between the relative intensive light source and the fiber optic cable.

16. The vending machine of claim 15 in which said second back light subassembly includes an electrical motor for rotating the color wheel, and means connecting the electrical motor to a source of power.

17. A method of highlighting a selected portion of a translucent sign panel defining at least part of a front of a housing of a vending machine, comprising the steps of:

obscuring the selected portion with an obstruction contained within the housing from a general back light source within the housing;

generating a light from a second light source of intensity relatively greater than light from the general back light source; and conveying the light from the second relatively greater intensive light source around the obstruction to impinge upon the selected portion of the translucent sign panel.

18. The method of claim 17 in which said step of conveying is performed by conveying light through a fiber optic cable.

19. The method of claim 17 including the step of conveying the light from the relatively greater intensive, second light source to the selected portion of the translucent light through a color wheel.

20. The method of claim 19 including the step of rotating the color wheel.

21. The method of claim 20 including the step of rotating the color wheel with means powered from a source of power shared by both the general back light source and the relatively greater intensive second light source.

22. In a vending machine having a mechanism for dispensing a food item, a controller responsive to receipt of payment for actuating the dispensing mechanism and a general back light assembly all contained within a common housing defined in part by a translucent panel including a first and second subpanels, the improvement being a retrofit back light assembly, comprising:

an elongate frame with means for mounting the elongate frame to a wall of the common housing spaced from the translucent panel;

a lamp socket mounted to the elongate frame and having means for releasable connection with an electrical lamp, and means for releasable connection with a power supply to obtain electrical power therefrom to light the electrical lamp;

a color wheel mounted to the elongate frame at a location relative to the lamp socket to receive light from an electrical lamp releasably connected therewith;

a fan mounted to the elongate frame for cooling an environment adjacent the lamp socket;

means for releasably mounting the second translucent subpanel into generally flush engagement with the first translucent subpanel;

an elongate bundle of fiber optic cables having one end mounted to the elongate frame for receipt of light through the color wheel from the electrical lamp; and means for mounting a distal end of the elongate bundle of fiber optic cables relative to the second translucent subpanel to convey light received at the one end to selected locations on the second translucent subpanel.

23. The vending machine of claim 22 including means for mounting the color wheel for rotation, and an electrical motor mounted to the elongate frame to rotatably drive the color wheel.

24. The vending machine of claim 23 including means for releasable connection with the power supply for providing electrical power to the electrical motor.

25. The vending machine of claim 23 in which said power supply has a power supply output for providing electrical power to the general back light assembly, and said releasable connecting means includes means for releasable connection of the electrical motor to said power supply output.

26. The vending machine of claim 25 in which said power supply has an input connected with a source of standard AC electrical power, and said means for releasable connection with the power supply includes means for releasable connection with the input.

27. The vending machine of claim 23 in which said color wheel is located intermediate the lamp socket and the electrical motor, and said means for mounting the distal end of the elongate bundle of fiber optic cables includes means for mounting the one end to the electrical motor.

28. The vending machine of claim 27 in which said mounting means mounts the fan to the elongate frame intermediate the lamp socket and the color wheel.

29. The vending machine of claim 22 in which said elongate frame includes an elongate member for connection along a side wall of the common housing, and transverse arms mounted along and extending from one side of the length of the elongate member for attaching the lamp socket, color wheel and the one end of the fiber optic cable in preselected spatial relationship.

* * * * *

UNITED STATES PATENT AND TRADEMARK OFFICE

CERTIFICATE OF CORRECTION

PATENT NO. : 5,193,901

DATED : March 16, 1993

INVENTOR(S) : David H. Stone

It is certified that error appears in the above-identified patent and that said Letters Patent is hereby corrected as shown below:

Column 4, line 1, after "assembly" delete ",,";
Column 4, line 17, after "primary" delete ",";
Column 4, line 29, after "32B" delete "to";
Column 4, line 54, after "40" delete "," and insert - ' -;
Column 5, line 40, after "second" insert - back -;
Column 5, line 52, after "invention" delete "a" and insert - as -;
Column 6, line 11, after "second" insert - back -;
Column 6, line 16, after "said" delete "back" and after "first" insert - back -;
Column 6, line 23, after "back" insert - light -;
Column 6, line 27, change "translucent" to - transparent -;
Column 6, line 34, change "translucent" to - transparent -; and
Column 6, line 56, before "assembly" insert - sub -.

Signed and Sealed this

Thirtieth Day of August, 1994

*Attest:*

Bruce Lehman

BRUCE LEHMAN

*Attesting Officer*

*Commissioner of Patents and Trademarks*